US005354033A

United States Patent [19]

Cheldin

[11] Patent Number: 5,354,033

[45] Date of Patent: Oct. 11, 1994

[54] DOUBLE-JAWED STAPLE REMOVER

[76] Inventor: Erwin Cheldin, 22907 Collins St., Woodland Hills, Calif. 91367

[21] Appl. No.: 59,638

[22] Filed: May 10, 1993

[51] Int. Cl.[5] ..... B25C 11/00

[52] U.S. Cl. ..... 254/28; 7/160

[58] Field of Search ..... 7/160, 125, 166; 254/28, 18; 29/267

[56] References Cited

U.S. PATENT DOCUMENTS

| | | | |
|---|---|---|---|
| 1,193,930 | 8/1916 | Schulz | 254/28 |
| 1,290,846 | 1/1919 | Smith | 254/28 |
| 1,495,028 | 5/1924 | Mitchell | 254/28 |
| 3,311,346 | 3/1967 | Almond | 254/28 |
| 3,934,286 | 1/1976 | Metzinger | 254/28 |
| 4,784,370 | 11/1988 | Strickland | 254/88 |
| 5,090,662 | 2/1992 | Koo | 254/28 |

FOREIGN PATENT DOCUMENTS

| | | | |
|---|---|---|---|
| WO91/2627 | 3/1991 | World Int. Prop. O. | 254/28 |

*Primary Examiner*—Robert C. Watson

*Attorney, Agent, or Firm*—Poms, Smith, Lande & Rose

[57] ABSTRACT

A staple remover is provided with first and second jaws which are pivotably connected for rotation about a single axis with the first and second jaws having wedging elements for prying a staple away from a stapled article, gripping elements for grasping opposing sides of a partially disengaged or sheared staple, at least one wire engaging edge for cutting wire, and arms to provide the operator with increased leverage.

9 Claims, 2 Drawing Sheets

DOUBLE-JAWED STAPLE REMOVER

BACKGROUND OF THE INVENTION

Field of the Invention

The present invention relates generally to apparatus and methods used to remove staples from stapled articles, and more particularly to double-jawed staple removers.

Description of Related Art

A wide variety of modern-day businesses utilize staple removers on a daily basis to effect disengagement of staples from stapled articles. Staple removers are also commonly used within the personal residence of the typical consumer. Of the commercially available hand-held staple removers utilized in both business and consumer applications, one of the most common types is the double-jawed staple remover.

The typical double-jawed staple remover is provided with first and second jaws which are pivotably connected for rotation towards one another about a single axis. The first jaw has a first pair of spaced apart walls which move in a plane which is perpendicular to the axis of rotation and which have wedging elements for engaging a staple. The second jaw has a second pair of spaced apart walls which also move in a plane which is perpendicular to the axis of rotation and which also have wedging elements for engaging a staple. The distance between the second pair of walls relative to the first pair of walls is such that, upon rotation of the first and second jaws towards one another into a closed position, the second pair of walls are positioned between and overlap with the first pair of walls.

The first and second jaws of these staple removers are typically provided with finger receiving elements which are positioned on the outside of the first and second jaws, respectively, substantially adjacent the wedging elements of the first and second pairs of walls.

To effect removal of a staple from a stapled article, the operator forcibly rotates the first and second jaws towards one another into overlapping positions, usually by applying a thumb to one finger receiving element and one or more fingers to the other finger receiving element, simultaneously driving the wedging elements of the first and second pair of walls between the staple and the stapled article and thereafter pulling or twisting the double-jawed staple remover so as to disengage the staple from the stapled article.

While the foregoing method and apparatus is generally effective in removing staples utilized in light duty applications such as the binding of articles having a thickness of not more than ⅛ of an inch, this method and apparatus has proven more cumbersome and less effective in removing staples in heavier duty applications where the stapled articles and/or the staples are thicker.

In these heavier duty applications, the operator must often apply substantial forces to the finger receiving elements and may succeed only in partially disengaging the staple from the stapled article. In the course of squeezing, pulling and/or twisting the staple, it is also common for the staple to shear so as to leave a portion of the staple within the stapled article with an exposed tip extending therefrom. Accordingly, the operator of these double-jawed staple removers must locate a pair of pliers or other suitable means for gripping and separating the partially disengaged or sheared staple from the stapled article. This is highly inefficient and results in the loss of valuable time.

It would thus be desirable to provide a double-jawed staple-remover with a pair of plier-like grippers for removing partially disengaged or sheared staples from a stapled article.

It would also be desirable to provide a double-jawed staple remover with a wire cutter so as to eliminate the need for a separate wire cutting implement (for those applications where a wire cutter is or might be required).

Additionally, it would be desirable to provide the operator of a double-jawed staple remover with increased leverage to effect removal of difficult-to-remove staples.

SUMMARY OF THE INVENTION

In accordance with the present invention, an improved staple remover having first and second jaws pivotably connected for rotation about a single axis is provided. The first and second jaws are provided with wedging elements for prying a staple away from a stapled article and gripping elements for grasping opposing sides of a partially disengaged or sheared staple.

As a feature of the present invention, the first jaw is provided with a wire engaging edge which can cooperate with the second jaw to cut wire.

As yet one more feature of the present invention, the first and second jaws are provided with arms which facilitate removal of difficult-to-remove staples by providing the operator with increased leverage.

The above features and many other features and advantages of the present invention will become better understood by reference to the following detailed description when taken in conjunction with the accompanying drawings.

DESCRIPTION OF PREFERRED EMBODIMENTS

Figure 1:
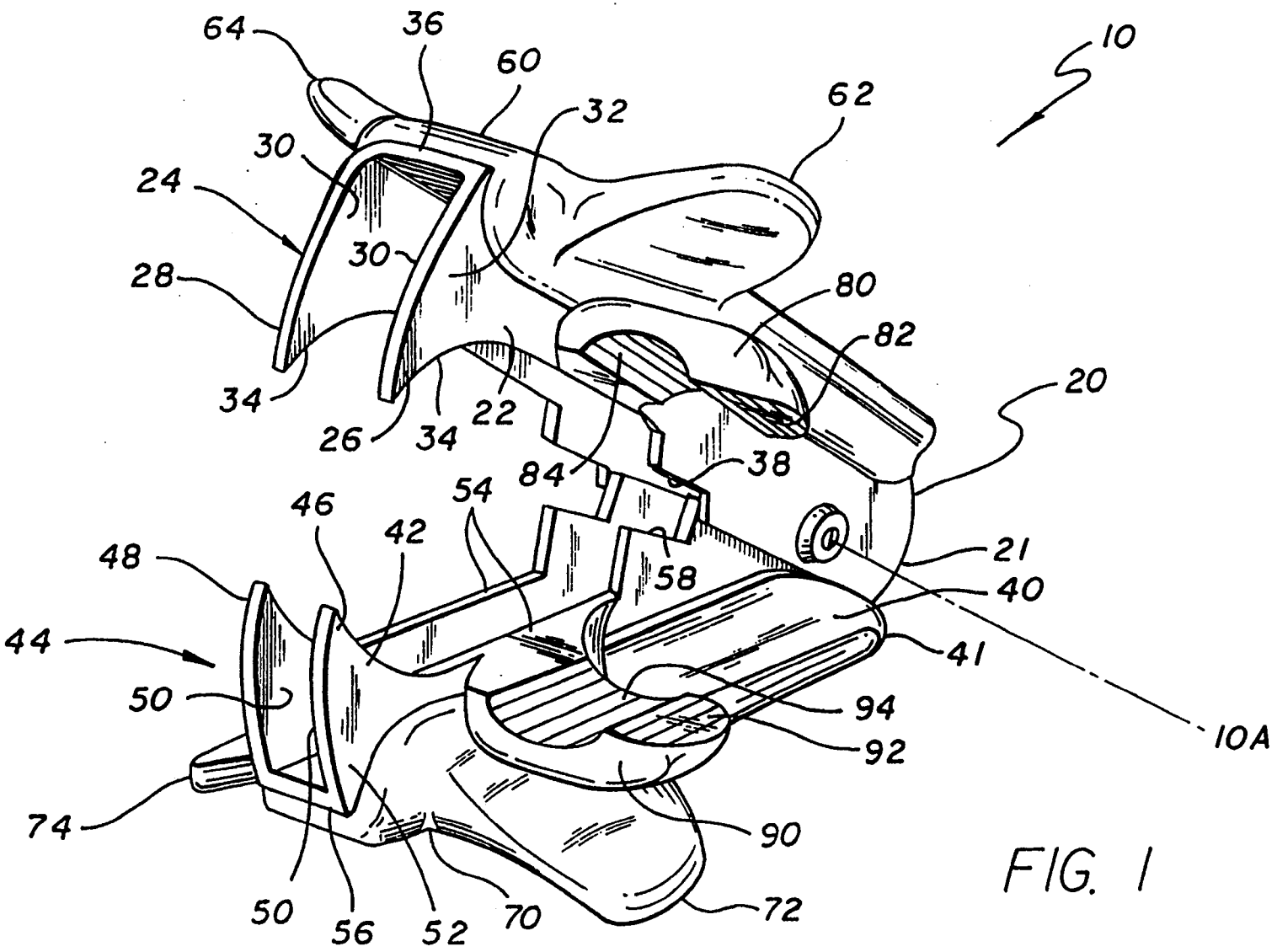
FIG. 1 is a perspective view of a first preferred exemplary embodiment of the present invention.

Referring initially to FIG. 1, a first preferred exemplary embodiment of an improved double-jawed staple remover is shown generally at 10. The improved staple remover 10 is provided with first and second jaws 20 and 40 which are pivotally connected at ends 21 and 41 for rotation towards one another about a single axis 10A. A spring (not shown) is provided to bias jaws 20 and 40 away from one another into the open position shown in FIG. 1.

The first jaw 20 has a pair of spaced apart walls 22 and 24 which move in a plane perpendicular to the axis of rotation 10A and which have wedging elements 26 and 28 positioned. Walls 22 and 24 each have an inner face 30, an outer face 32 and an edge 34. The second jaw 40 has a pair of spaced apart walls 42 and 44 which also move in a plane perpendicular to the axis of rotation 10A and which have wedging elements 46 and 48 at the ends thereof. Walls 42 and 44 include inner faces 50, outer faces 52 and edges 54.

The distance between the second pair of walls 42 and 44 relative to the first pair of walls 22 and 24 is preferably such that, upon rotation of the first and second jaws towards one another, the inner faces 30 of wall 22 and 24 slidably engage the corresponding outer faces 52 of walls 42 and 44, with walls 42 and 44 being positioned between and overlapping with walls 22 and 24 when the improved staple remover 10 is in a closed position (not shown).

A first finger receiving element 60 is provided on the first jaw 20 to facilitate manual rotation of the first jaw 20 into slidable engagement with the second jaw 40. Similarly, a second finger receiving element 70 is provided on the second jaw 40 to facilitate manual rotation of the second jaw 40 into slidable engagement with the first jaw 40.

The first finger receiving element 60 includes a first pair of finger tabs 62 and 64 which extend away from the first jaw 20 in opposing directions which are substantially parallel to the axis of rotation 10A. Similarly, the second finger receiving element 70 includes a second pair of finger tabs 72 and 74 which extend away from the second jaw 40 in opposing directions which are substantially parallel to the axis of rotation 10A.

Figure 2:
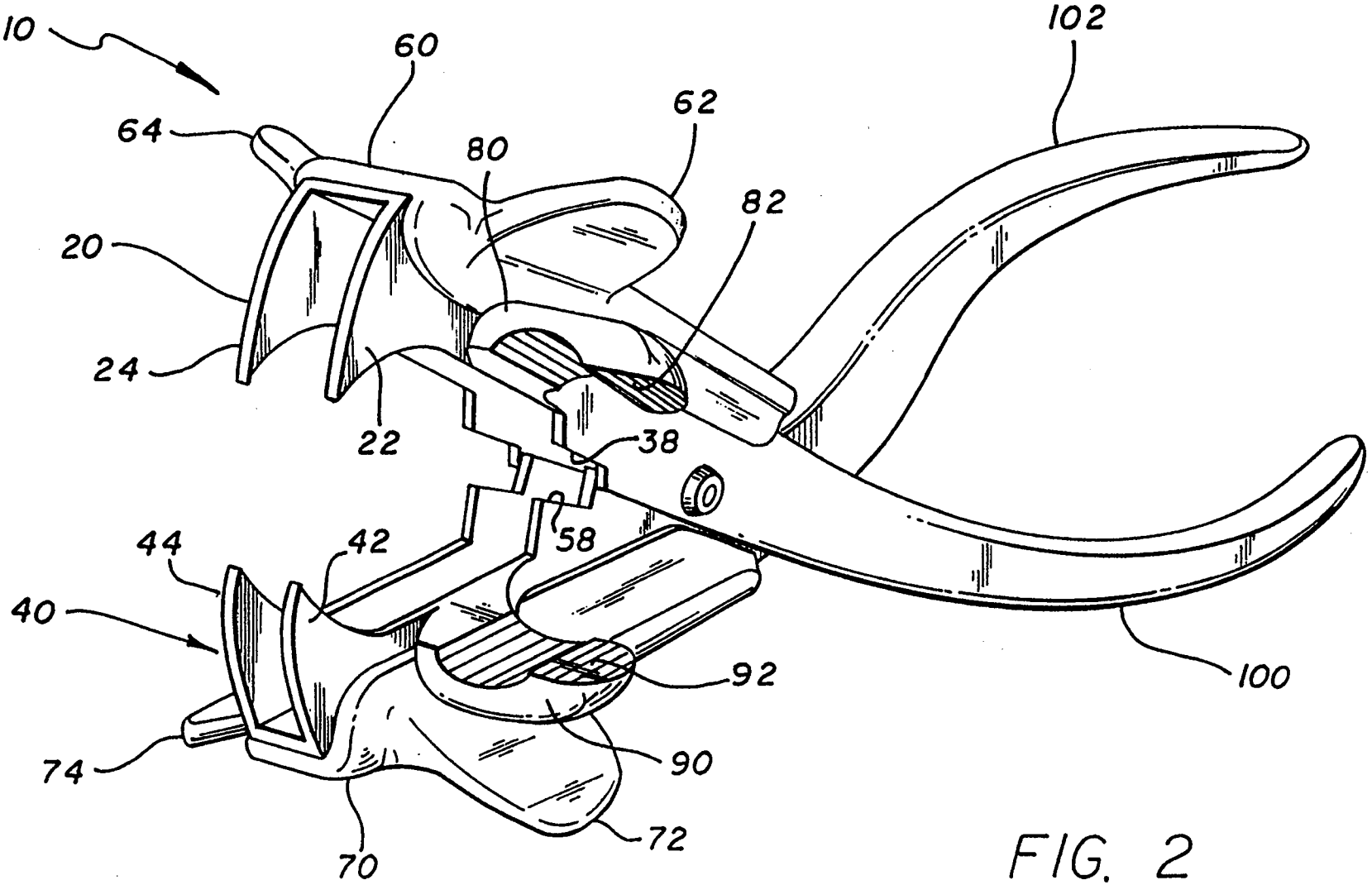
FIG. 2 is a perspective view of a second preferred exemplary embodiment of the present invention.

As best shown in FIG. 2, the first and second jaws 20 and 40 are also provided with an opposing pair of gripping elements 80 and 90 which cooperate to engage and detach difficult-to-remove staples from stapled articles.

Gripping element 80 is provided on the outer face 32 of wall 22 between edge 36 and finger tab 62, extending away from the first jaw 20 in a direction substantially parallel to the axis of rotation 10A. The opposing gripping element 90 is similarly positioned on wall 42 between edge 56 and finger tab 72.

The first and second gripping elements 80 and 90 include primary gripping surfaces 82 and 92, respectively. The primary gripping surfaces 82 and 92 are configured for substantially complemental engagement.

To effect removal of a partially disengaged staple or a sheared staple from a stapled article, the operator needs only to rotate the improved staple remover 10 within his or her hand 90 degrees from the normal position of use and then, using a thumb applied to one finger receiving element and one or more fingers applied to the other finger receiving element, squeezing the primary gripping surfaces 82 and 92 into simultaneous engagement with the subject staple and thereafter pulling or twisting the double-jawed staple remover so as to completely disengage the partially disengaged or sheared staple from the stapled article.

The primary gripping surfaces 82 and 92 extend beyond the ends of finger tabs 62 and 72 sufficiently to ensure proper engagement with a partially disengaged or sheared staple without interference from finger tabs 62 and 72. Preferably, the primary gripping surfaces 82 and 92 are provided with discontinuities to improve the gripping characteristics thereof. In the preferred embodiment shown in FIGS. 1 and 2, gripping surfaces 82 and 92 are provided within a plurality of ridges 84 which extend in a direction perpendicular to the axis of rotation of the first and second jaws 20 and 40.

Those skilled in the art will understand that the finger tabs are not part of any present invention and may be excluded or reduced in size where desired. It will also be understood by those skilled in the art that the gripping elements 80 and 90 may be positioned anywhere on the first and second jaws 20 and 40, respectively, so long as the gripping elements 80 and 90 cooperate to grasp a partially disengaged or sheared staple.

The first and second gripping elements may also be provided with secondary gripping surfaces 84 and 94. Preferably, secondary gripping surfaces 84 and 94 are configured so as to define a small cavity therebetween when the first and second jaws 20 and 40 are in the closed position (not shown) for gripping objects having a thickness which is greater than distance between the first and second secondary gripping surfaces.

The improved staple remover 10 may also be provided with wire cutters to further render the staple remover a multi-purpose implement. In the preferred embodiment shown in FIGS. 1 and 2, edges 34 and 54 of walls 22 and 42 are provided with wire engaging portions 38 and 58. Wire engaging portions 38 and 58 are straight-edged closely mating surfaces. A wire can be sheared by placing the wire between the wire engaging portions 38 and 58 of edges 34 and 54, respectively, and rotating the first and second walls 22 and 42 towards one another into slidable engagement.

Those skilled in the art will understand wire may be cut with other opposing wire engaging surfaces. For example, one or both of the primary gripping surfaces 82 and 92 may be provided with a wire engaging edge which cooperates with the opposing primary gripping surface to cut wire as the primary gripping surfaces 82 and 92 are rotated into engagement.

As best shown in FIG. 2, the improved staple remover 10 may also include lever arms 100 and 102. Arms 100 and 102 extend from the first and second jaws 20 and 40, respectively. Arm 100 and first jaw 20 are disposed on opposing sides of axis 10A. Arm 102 and second jaw 40 are similarly disposed on opposing sides of axis 10A. The operator can manipulate arms 100 and 102 to effect rotation of the jaws 20 and 40 into the closed position. The spring (not shown) biases lever arms 100 and 102 away from one another thus biasing jaws 20 and 40 away from one another.

Preferably, the arms 100 and 102 are curved inwardly, as best shown in FIG. 2, to accommodate the operator's hand. Those skilled in the art will understand arms 100 and 102 may be otherwise configured so long as the configuration provides the operator with increased leverage in removing staples (and in cutting wire if the improved staple remover 10 is provided with at least one wire engaging edge as described above).

For most applications, it is preferred that jaws 20 and 40, gripping elements 80 and 90 and arms 100 and 102, if any, be composed of a rigid durable oxidation-resistant material such as stainless steel. Those skilled in the art will also understand that gripping elements 80 and 90 and arms 100 and 102 may be integrally formed with jaws 20 and 40 or, alternatively, may be attached thereto using conventional means.

The finger receiving elements 60 and 70 may also be integrally formed with first and second jaws 20 and 40, respectively. However, it is preferred that the finger receiving elements 60 and 70 be composed of a hard plastic or other low cost material suitable for the application. It will be understood by those skilled in the art that the finger receiving elements 60 and 70 are optional features which need not be provided where the improved staple remover 10 includes first and second arms 100 and 102.

Having thus described the foregoing exemplary embodiments of the present invention, it should be noted by those skilled in the art that the disclosures within are exemplary only and that various other alternatives, adaptations and modifications may be made within the scope and spirit of the present invention. Accordingly, the scope of the present invention is not limited to the specific embodiments as illustrated herein, but is only limited by the following claims and equivalents thereof.

What is claimed is:

1. An apparatus for removing staples comprising:

first and second jaws which are pivotably connected for rotation about an axis;

a first wedging element connected to said first jaw and a second wedging element connected to said second jaw which can cooperate to pry a staple away from a stapled article;

a first gripping element connected to and extending laterally from said first jaw, said first gripping element having a primary gripping surface at the free end thereof and a secondary gripping surface disposed between said first jaw and said primary gripping surface;

a second gripping element connected to and extending laterally from said second jaw, said second gripping element having a primary gripping surface at the free end thereof and a secondary gripping surface disposed between said second jaw and said primary gripping surface;

said primary gripping surfaces being configured such that, upon rotation of said first and second jaws towards one another, said primary gripping surfaces can cooperate to grasp an object as small as a partially removed staple;

said secondary gripping surfaces being concave such that, when said primary gripping surfaces are rotated into engagement with one another, an aperture is defined therebetween which extends between said first and second jaws, on the one hand, and said primary gripping surfaces, on the other hand, said aperture being sufficiently large to facilitate the grasping of objects which are substantially larger than an partially removed staple.

2. The apparatus of claim 1 wherein said first and second jaws further comprise inner edges which, upon rotation of said first and second jaws towards one another, can cooperate to cut wire.

3. The apparatus of claim 2 wherein:

said first and second jaws slidably engage as said first and second jaws are rotated towards one another into a closed position; and said first and second wire engaging edges can cooperate to cut wire as said first and second jaws slidably engage.

4. The apparatus of claim 3 wherein said first and second jaws are pivotally connected at an end of each, further comprising:

a first lever arm extending from said first jaw, said first lever arm and said first jaw being disposed on opposing sides of said axis; and a second lever arm extending from said second second jaw which can cooperate with said second arm to effect rotation of said first and second jaws about said axis, said second lever arm and said second jaw being disposed on opposing sides of said axis.

5. The apparatus of claim 1 wherein said first and second jaws are pivotally connected at an end of each, further comprising:

a first lever arm extending from said first jaw, said first lever arm and said first jaw being disposed on opposing sides of said axis; and a second lever arm extending from said second second jaw which can cooperate with said second arm to effect rotation of said first and second jaws about said axis, said second lever arm and said second jaw being disposed on opposing sides of said axis.

6. A staple remover having first and second jaws which are pivotably connected for rotation about a single axis and having first and second elements which can cooperate to pry a staple away from a stapled article wherein the improvement comprises:

a first gripping element connected to and extending laterally from said first jaw and a second gripping element connected to and extending laterally from said jaw;

said first and second gripping element being configured to resemble a pair of conventional plier-heads having primary gripping surfaces at the free ends thereof and secondary gripping surfaced disposed between said primary gripping surfaces and said jaws such that, upon rotation of said first and second jaws towards one another, said primary gripping surfaces can be used to grasp an object as small as partially removed staple or said secondary gripping surfaces can be used to grasp substantially larger objects.

7. The apparatus of claim 6 wherein said first and second jaws further comprise inner edges which, upon rotation of said first and second jaws towards one another, can cooperate to cut wire.

8. The apparatus of claim 7 wherein:

said first jaw has a first wall having a first wire engaging edge and said second jaw has a second wall having a second wire engaging edge;

said first and second walls slidably engage as said first and second jaws are rotated towards one another into a closed position; and said first and second wire engaging edges can cooperate to cut wire as said first and second walls slidably engage.

9. The apparatus of claim 7 wherein said first and second jaws are pivotally connected at an end of each, further comprising:

a first lever arm extending from said first jaw, said first lever arm and said first jaw being disposed on opposing sides of said axis; and a second lever arm extending from said second second jaw which can cooperate with said second arm to effect rotation of said first and second jaws about said axis, said second lever arm and said second jaw being disposed on opposing sides of said axis.

* * * * *